United States Patent [19]

McGregor

[11] Patent Number: 4,843,850

[45] Date of Patent: Jul. 4, 1989

[54] TIME RELEASE LOCK

[76] Inventor: Jon D. C. McGregor, 493 Church Street, Richmond, 3121, Victoria, Australia

[21] Appl. No.: 118,082

[22] Filed: Oct. 28, 1987

[30] Foreign Application Priority Data

Oct. 28, 1986 [AU] Australia ..... PH8725

[51] Int. Cl.[4] ..... E05B 43/00

[52] U.S. Cl. ..... 70/268; 70/143; 70/272

[58] Field of Search ..... 70/267, 268, 269, 270, 70/271, 272, 143, DIG. 50

[56] References Cited

U.S. PATENT DOCUMENTS

| | | | |
|---|---|---|---|
| 2,077;365 | 4/1937 | Millice | 70/269 |
| 2,095,429 | 10/1937 | Benham | 70/269 |
| 2,294,505 | 9/1942 | Lindblad | 70/269 |
| 2,318,908 | 5/1943 | Welch | 70/268 |
| 3,076,329 | 2/1963 | Maynard | 70/272 |
| 3,660,998 | 5/1972 | Ishijima | 70/269 |

FOREIGN PATENT DOCUMENTS

| | | | |
|---|---|---|---|
| 2808391 | 9/1979 | Fed. Rep. of Germany | 70/269 |
| 4937 | of 1893 | United Kingdom | 70/269 |

*Primary Examiner*—Lloyd A. Gall

*Attorney, Agent, or Firm*—Sughrue, Mion, Zinn, Macpeak & Seas

[57] ABSTRACT

The time release lock has three lock positions; open, a first locked position without time delay and a second locked position with time delay. The lock has a tongue which is withdrawn in the open position, extended to a certain extent in the first locked position and extended to a further extent in the second locked position. The lock can only be moved from the second locked position to the first locked position under influence of a timer.

10 Claims, 4 Drawing Sheets

TIME RELEASE LOCK

FIELD OF THE INVENTION

This invention relates to time release locks.

SUMMARY OF THE INVENTION

According to one aspect of this invention, there is provided a time release lock comprising a latching element, operating means movable from a first position to a second position to cause the latching element to be moved from an unlatching to a first latching position from which first latching position the latching element can be returned to its unlatching position by movement of the operating means back to the first position, said operating means also being movable to a third position to cause the latching element to be moved to a second latching position from which it cannot be returned to the unlatching position solely by movement of the operating means, timing means being provided, effective on movement of the operating means from the third to the second position to move the latching element from its second unlatched position to its first unlatched position, after a time delay, from which second unlatched position it can then be moved to the unlatching position by movement of the operating means from the second to the first position thereof.

The latching element may be in the form of a tongue which is retractable into a casing of the lock to position it to its unlatching position and which is movable to a first degree of extension from the casing to position it at its first latching position and movable to a second, relatively greater degree of extension from the casing to position it at its second latching position. The latching element may be mounted for linear movement between its three positions and may be resiliently biased in the direction of movement and away from the unlatching position. The operating means may be rotatably movable successively through the first, second and third positions thereof such as when freed for such turning by a key-freed lock or other subsidiary locking device. The operating means may be provided with a first abutment co-operable with a second abutment on the latching element to move the latching element against the aforementioned resilient bias from the first latching position to the unlatching position, on rotation of the operating means from the second to the first position thereof. The second abutment is preferably so positioned, then, as to permit the release of engagement between that abutment and the first abutment on the operating means during movement of the operating means away from said first position, towards said second position, whereby, pursuant to such movement of the operating means, the latching element is moved under resilient bias from the unlatching position to its first latching position. Preferably, in this instance, the timing means includes a movable abutment to engage the latching element to limit movement of the latching element so as not to extend past the first latching position, under the condition that the operating means is at its second position. The operating means may, in this instance, be movable to engage the latching element and move the latching element from its first latching position to its second latching position, when the operating means is moved from its second position to its third position. The latching movement may include a third abutment which, during movement of the latching element from its first to its second latching position, engages the movable abutment of the timing means to cause the abutment to be moved a predetermined distance, to condition the timer means for subsequent operation. In this instance, so long as the operating means is at its third position and the locking element is maintained at its second latching position pursuant to engagement of the operating means with the latching element, the timer means may remain unoperated. However, the timer means may be arranged whereby, on a subsequent movement of the operating means from the third to the second position, the operating means is disengaged from the latching element, after a time delay, back from its second latched position to its first latched position.

BRIEF DESCRIPTION OF THE DRAWINGS

The invention is further described by way of example only with reference to the accompanying drawings in which.

DESCRIPTION OF THE PREFERRED EMBODIMENT

Figure 1:
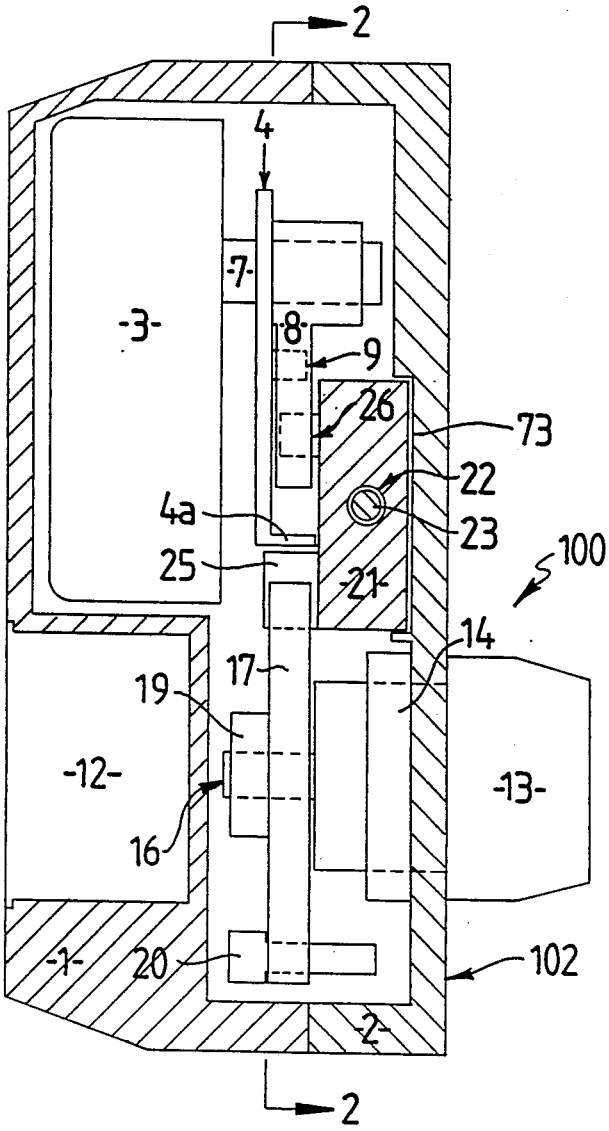
FIG. 1 is an upright front to rear cross section of a lock constructed in accordance with the invention.

The lock 100 shown includes a casing 102 formed of two sections being a rear lock case 1 and a front lock case 2 which are secured together such as by use of screws extending through holes 27. The casing 102 also has openings 28 to permit the lock to be fitted to a door or the like.

The rear lock case 1 is provided with a clockwork timer 3 secured to a timer plate 4 by screws which pass through two holes 5 in the timer plate. The timer plate is in turn fixed to shoulders in the rear lock case, by screws extending through two holes 6 in the timer plate.

The clockwork timer 3 has a shaft 7 of D-shaped cross section which protrudes through a hole in the timer plate 4. A timer arm 8 is press fitted over the shaft 7, being neatly accommodated in a D-shaped opening through the timer arm, whereby timer arm 8 is secured to the shaft 7 for rotation therewith.

Figure 2:
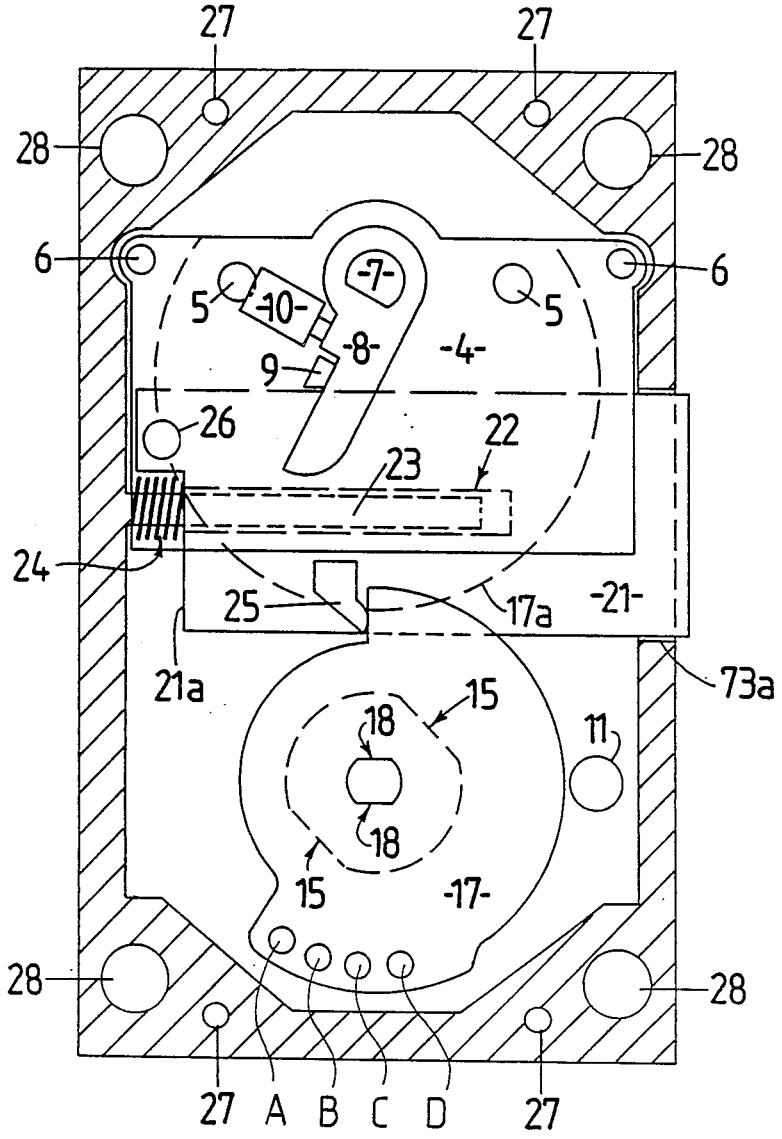
FIG. 2 is a partly diagrammatic view approximately on the line 2—2 in FIG. 1, showing the lock in an "open" position.

As viewed in FIG. 2, clockwise movement of the timer arm 8 is limited to a position in which the arm engages an upstand 9 formed on the timer plate. An electric plunger switch 10 is fixed to the timer plate 4 in such a position that when the timer arm 8 is located against the upstand 9, the switch 10 has its operating button depressed to close an electric circuit (not shown) which includes an LED 11 on the outside of the lock case 2 so as to cause the electric circuit to light up the LED. The power for the electric circuit is provided by battery 12 located in the lock case 1.

A three position key actuated mechanical lock 13, such as a tumbler lock, is located on the lock case 2 so as to extend through an opening in the front wall of the lock case 2. The lock 13 is secured to the lock case 2 by a nut 14. The exterior body of the lock 13 and the opening in the lock case 2 through which this extends are each provided with complimentary co-operating flats 15 (FIG. 2) to prevent rotation of the lock body relative to the lock case 2.

The lock 13 has a rearwardly extending lock shaft 16 which is rotatable, under corresponding rotation of a properly fitting key when inserted in the lock 13. The lock shaft 16 carries an operating wheel 17. The center hole of the wheel, through which the shaft 16 extends, has two flats 18 and the lock shaft 16 has complimentary flats which engage these whereby rotation of the wheel relative to the lock shaft is prevented. The wheel is secured to the lock shaft by a nut 19 received on a threaded end portion of a shaft 16.

Figure 3:
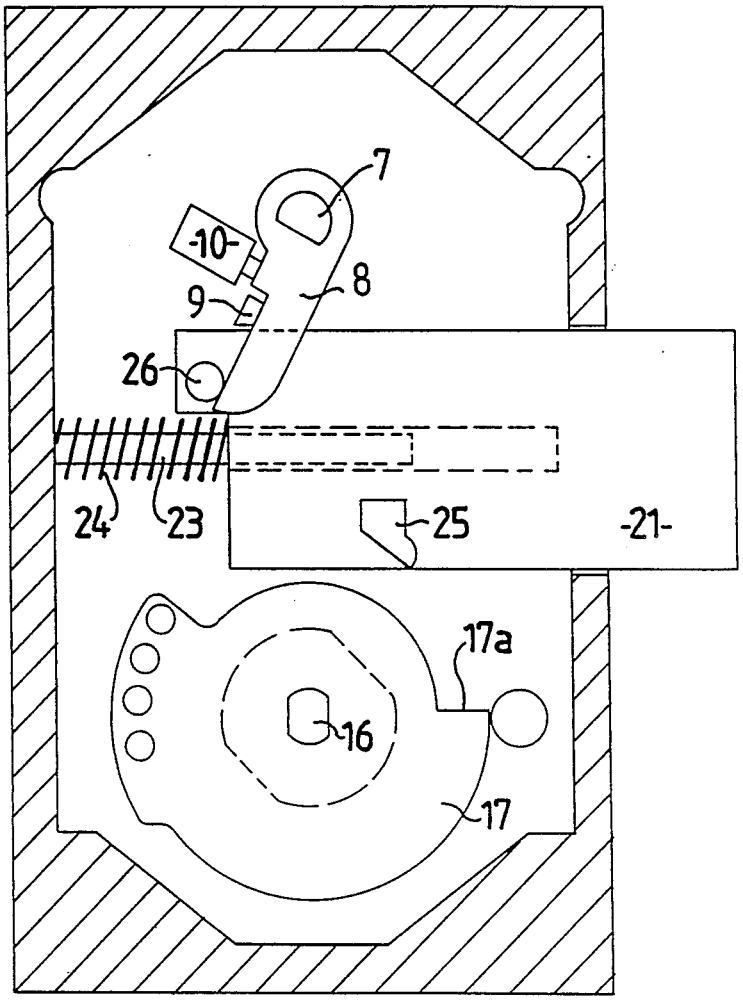
FIG. 3 is a view like FIG. 2 but showing the lock in an "intermediate" locked position.
Figure 4:
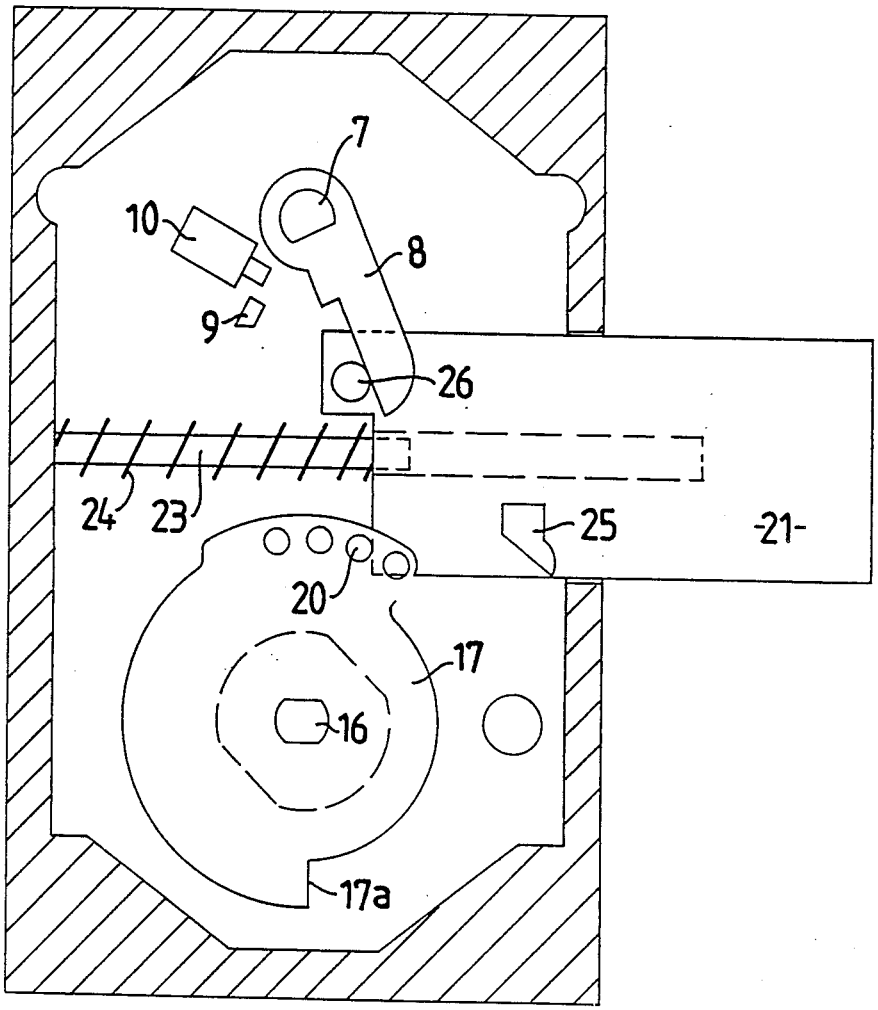
FIG. 4 is a view like FIG. 2 but showing the lock in a "time lock" position.

The lock case 2 is provided with a transverse groove 73 open to the exterior of the lock case at an opening 73*a*. A lock tongue 21 is slideably retained in the groove by a return 4a formed in the timer plate 4. In an "open" or unlatching position of the tongue 21 as shown in FIG. 2, the tongue is substantially fully retracted along the groove 73 to be substantially wholly retained within the casing 102. However, the tongue can be slid outwardly to project to varying extents as shown in FIGS. 3 and 4.

At the inner end of the tongue, the tongue is provided with a blind bore 22 which fits over and slidingly accommodates a pin 23 secured to the inside of the lock case 2. A compression spring 24 is positioned over the pin 23 and between a side wall of the lock case 2 and the inner end of the tongue 21, whereby to resiliently bias the tongue 21 away from the retracted position in FIG. 2 in the direction towards the position shown in FIG. 3 and 4.

At one side, the tongue 21 is provided with a shaped upstand 25. The periphery of the timer wheel 17 is of complex form presenting, however, at one peripheral location a radially extending abutment surface 17*a* which is engagable with the upstand 25 during operation of the lock. The wheel also has a series of four openings labelled "A", "B", "C", and "D" in the drawings, and these are arranged on a common pitch circle at equi- angularly spaced locations, all angularly spaced relative to the abutment surface 17*a*. A press fit pin 20 is positionable selectively in any one of the holes A, B, C, and D and, under certain conditions of rotation of the wheel 17, are effective to engage a rear end heel 21*a* of the tongue 21 to effect movement thereof. The tongue 21 also has, at one side thereof, a projecting pin 26 which cooperates, as described later, with the timer arm 8 during certain movements of the tongue.

The operation of the lock is now described. Firstly, the lock has three conditions shown respectively in FIGS. 2, 3 and 4, corresponding to three different rotational positions of the wheel 17. These three conditions and corresponding positions of the wheel 17 are for convenience described hereafter as, "open", "lock", "time lock" conditions and positions and correspond to unlatched, and first and second latching portions respectively of the tongue 21. Insofar as the wheel 17 is concerned, the three positions correspond to positions of 0 degrees, 90 degrees and 180 degrees rotational displacement from a reference position being the open position shown in FIG. 2. These positions are the three positions of rotation of the shaft 16 which can be brought about by operation of a key when inserted into the lock 13.

OPEN CONDITION

In this (FIG. 7) the lock key, and hence the lock shaft 16 are positioned such that the abutment surface 17*a* on the wheel 17 is engaged with the upstand 25 on the tongue 21 so that the spring 24, which biases the tongue 21 outwardly is prevented from moving the tongue outwardly from the retracted position of FIG. 2 by virtue of the inter engagement between the upstand 25 and the surface 17*a*. In this position, it will be noted that the timer arm 8 is positioned to depress the electrical plunger switch 10 as previously mentioned, closing the electrical circuit and lighting the LED 11 to indicate to a user that the lock is in the "open" position.

LOCK CONDITION

On turning of the lock key and hence the lock shaft 16 through 90 degrees from the position of FIG. 2 (as viewed in FIGS. 2, 3 and 4) to the position shown in FIG. 3, the wheel 17 is aslo rotated 90 degrees clockwise to the position shown in FIG. 3 where the abutment surface 17*a* of the wheel is moved away from the tongue upstand 25. This allows the compression spring 24 to act against the tongue 21 to move the tongue outwardly to the first latching position as shown in FIG. 3, where further movement is prevented by engagement of the pin 26 against the timer arm 8. The strength of spring 24 is such that it is less than that required against the arm 8 to rotate the arm 8 and the shaft 7 of the clockwork timer 3. Since the timer arm does not move, the electrical plunger switch 10 remains actuated and the LED circuit remains closed so that the LED remains alight. In this position of the tongue 21, the tongue has moved sufficiently to lock a door or drawer to which the lock in use is attached. The key of lock 13 may be removed in this condition of the lock 100 to maintain the lock 100 in the locked condition.

TIME LOCK POSITION

When the key and hence the lock shaft 16 and wheel 17 are rotated a further 90 degrees clockwise from the FIG. 3 portion to that shown in FIG. 4, the pin 20 in the wheel 17 strikes the heel 21*a* of the tongue 21 and drives the tongue further outwardly to assume the position of FIG. 4. The amount of throw of the tongue from the position in FIG. 3 to that in FIG. 4 is determined by the position of the pin 20, that is to say by the selection which has been made as to which of the holes "A", "B", "C" or "D" the pin is placed. The pin may be moved as desired by the owner of the lock. The pin, if placed in hole "A" drives the tongue furtherest, if placed in hole "D" the least and if positioned in either of holes "B" and "C" drives the tongue in varying degrees between those established in positions "A" and "D".

As the tongue 21 is driven out, the pin 26 on the tongue engages the timer arm 8 to drive it in an anticlockwise arc of movement (as shown in FIGS. 2 to 4) so as to wind up the clockwork timer 3. The degree of rotational movement which the timer arm 8 thus undergoes is dependent upon the distance which the tongue travels during each movement and is thus also dependent upon the position of the pin 20 on the wheel 17. That is to say the positioning of the pin also determines the degree of rotation of the clockwork timer shaft 7 and hence the length of time that is set into the timer.

As the timer arm is so rotationally moved, it moves away from the electrical plunger switch 10, thus releasing the switch plunger which in turn opens the electrical circuit controlling the LED 11 so as to turn the LED 11 off.

As the completion of this further 90 degrees of movement, the lock key may be withdrawn from the lock 13, thus leaving the wheel 17 locked in the position shown in FIG. 4. Therefore, the tongue 21 is left in this extreme thrown position, or second latched position, and the clockwork timer is prevented from unwinding.

The lock may be readily conditioned to revert it from its intermediate lock position shown in FIG. 3 to the open position shown in FIG. 2 merely by inserting the key in the lock 13 and turning it to move the wheel 17 so as to cause the abutment surface 17*a* of the wheel to engage the upstand 25 and drive the tongue 21 back to the FIG. 2 position. However, in order to unlock the lock when it is in the time lock position of FIG. 4, the operator first reinserts the key into the lock 13 and moves the key 90 degrees anti-clockwise as viewed in FIGS. 2 to 4 to correspondingly drive the wheel 17 so that the wheel rotates and the pin 20 is moved away from the heel 21*a* of the tongue 21. The arm 8 of the timer 3 is then freed from restraint, the timer 3 commences unwinding and, by virtue of the timer arm 8 acting against the pin 26, commences to drive the tongue via the arm 8 back towards the position of FIG. 3, compressing the spring 24 during such action. If, at any time before reversion of the tongue 21 back to the position shown in FIG. 3 an attempt is made to withdraw the tongue 21 to the position of FIG. 2 by operating the lock 13 to rotate the wheel 17 a further 90 degrees anti-clockwise from the FIG. 3 to the FIG. 2 position no movement of the tongue 21 will in fact occur, since the abutment surface 17*a* will move clear of the upstand 25, the latter not having moved back sufficiently to permit engagement with the abutment surface 17*a*. In fact, any attempt to withdraw the tongue 21 will fail until such time as the clockwork timer 3 has unwound sufficiently to move the tongue 21 fully back to the position of FIG. 3. This position is reached when the timer arm 8 strikes the timer plate upstand 9 and is thus prevented from further movement. The amount of time delay before the tongue so moves back to this position is predetermined by the amount of time which was "wound" onto the timer as predetermined by the distance the tongue 21 travelled during movement from the intermediate position of FIG. 3 to the position of FIG. 4. Thus the reversion time is determined by the position of the pin 20 in the selected hole "A", "B", "C" or "D" in wheel 17.

When the position of FIG. 3 is again reached, the timer arm 8 actuates the electrical switch 10, thus closing the electric circuit for the LED 11 and causing the LED 11 to light up. The LED 11 therefore indicates to the operator that the tongue has moved back far enough to permit the lock to be again reverted to the FIG. 2 position by a further 90 degrees anti-clockwise movement of the key, to cause the abutment surface 17*a* of the wheel 17 to engage with the upstand 25 and thence to move the tongue back to the open position.

The described arrangement has been advanced merely by way of explanation and many modifications may be made thereto without departing from the spirit and scope of the invention which includes every novel feature and combination of novel features herein disclosed.

I claim:

1. A time release lock comprising a latching element, operating means movable from a first position to a second position to cause the latching element to be moved from an unlatching position to a first latching position from which first latching position the latching element can be returned to its unlatching position by movement of the operating means back to the first position, said operating means also being movable to a third position to cause the latching element to be moved to a second latching position from which it cannot be immediately returned to the unlatching position solely by movement of the operating means, timing means being provided, effective on movement of the operating means from said third position to said second position to move the latching element from its second latching position to its first latching position, to produce a time delay, whereafter from which first latching position the latching element can then be moved to said unlatching position by movement of the operating means from said second position to said first position thereof.

2. A time release lock as claimed in claim 1, wherein the latching element is in the form of a tongue which is retractable into a casing of the lock to position it to said unlatching position and which is movable to a first degree of extension from the casing to position it at said first latching position and movable to a second, relatively greater degree of extension from the casing to position it at said second latching position.

3. A time release lock as claimed in claim 2, wherein the latching element is mounted for linear movement between its three positions and is resiliently biased in the direction of movement and away from said unlatching position.

4. A time relase lock as claimed in claim 3, wherein the operating means is rotatably movable successively through said first position, said second position and said third position thereof such as when freed for such turning by a key-freed lock.

5. A time release lock as claimed in claim 4, wherein the operating means is provided with a first abutment cooperable with a second abutment on the latching element to move the latching element against the aforementioned resilient bias from said first latching position to said unlatching position, on rotation of the operating means from said second position, to said first position thereof.

6. A time release lock as claimed in claim 5, wherein the second abutment is so positioned as to permit the release of engagement between that abutment and the first abutment on the operating means during movement of the operating means away from said first position, towards said second position, whereby, pursuant to such movement of the operating means, the latching element is moved under resilient bias from said unlatching position to said first latching position.

7. A time release lock as claimed in claim 6, wherein the timing means includes a movable abutment to engage the latching element during said time delay to prevent movement of the latching element during said time delay from said first latching position to said unlatching position.

8. A time release lock as claimed in claim 7, wherein the operating means is movable to engage the latching element and move the latching element from said first latching position to said second latching position, when the operating means is moved from said second position to said third position.

9. A time release lock as claimed in claim 8, wherein the latching element includes a third abutment which, during movement of the latching element from said first to said second latching position, engages the movable abutment of the timing means to cause the third abutment to be moved a predetermined distance, to condition the timer means for subsequent operation.

10. A time release lock as claimed in claim 9, wherein the timer means is arranged to remain unoperated so long as the operating means is at said third position and the latching element is maintained at said second latching position.

* * * * *